US009233270B2

(12) United States Patent
Luis Jacobo

(10) Patent No.: US 9,233,270 B2
(45) Date of Patent: Jan. 12, 2016

(54) RANGE OF MOTION EXERCISE THERAPY BAND

(71) Applicant: Catalina Luis Jacobo, San Antonio, TX (US)

(72) Inventor: Catalina Luis Jacobo, San Antonio, TX (US)

( * ) Notice: Subject to any disclaimer, the term of this patent is extended or adjusted under 35 U.S.C. 154(b) by 41 days.

(21) Appl. No.: 13/998,202

(22) Filed: Apr. 17, 2014

(65) Prior Publication Data

US 2014/0329648 A1 Nov. 6, 2014

Related U.S. Application Data

(60) Provisional application No. 61/795,606, filed on Oct. 22, 2012.

(51) Int. Cl.

| | |
|---|---|
| ***A63B 21/00*** | (2006.01) |
| ***A63B 21/062*** | (2006.01) |
| ***A63B 21/008*** | (2006.01) |
| ***A63B 71/00*** | (2006.01) |
| ***A63B 21/06*** | (2006.01) |
| ***A63B 21/055*** | (2006.01) |
| ***A63B 21/065*** | (2006.01) |
| *A63B 21/072* | (2006.01) |
| *A63B 23/00* | (2006.01) |

(52) U.S. Cl.

CPC ..... *A63B 21/0601* (2013.01); *A63B 21/00189* (2013.01); *A63B 21/0552* (2013.01); *A63B 21/065* (2013.01); *A63B 2021/0722* (2013.01); *A63B 2023/006* (2013.01); *A63B 2210/50* (2013.01); *A63B 2225/68* (2013.01)

(58) Field of Classification Search

CPC ..... A63B 21/0004; A63B 21/00178; A63B 21/00185; A63B 21/00189; A63B 21/002; A63B 21/0023; A63B 21/0552; A63B 21/0555; A63B 21/0557; A63B 21/0601–21/0607; A63B 21/0609; A63B 21/065; A63B 21/1446; A63B 21/1449; A63B 21/1465; A63B 21/1469; A63B 21/1476; A63B 21/1484; A63B 21/151; A63B 2021/0722; A63B 2023/006; A63B 2210/00; A63B 2210/50; A63B 2225/62; A63B 2225/64; A63B 2225/68; A63B 2225/682; A63B 2225/685; A63B 2225/687

See application file for complete search history.

(56) References Cited

U.S. PATENT DOCUMENTS

| | | | | |
|---|---|---|---|---|
| 5,839,992 | A * | 11/1998 | Phillips | 482/49 |
| 7,828,703 | B1 * | 11/2010 | Boesch | 482/112 |
| 8,231,510 | B2 * | 7/2012 | Abdo | 482/105 |
| 2014/0206508 | A1 * | 7/2014 | Hall | 482/105 |

* cited by examiner

*Primary Examiner* — Oren Ginsberg

(57) ABSTRACT

A range of motion therapy apparatus and kit according to the present invention includes an elongate body member having a flexible construction and generally tubular configuration defining an open space, the body member having an open proximal end and a closed distal end opposite the proximal end. The apparatus and kit includes a tubular receptacle having a closed bottom and a continuous side wall extending upwardly from the closed bottom that, together, define an interior area and an open top. The tubular receptacle includes a diameter smaller than a diameter of the body member such that the tubular receptacle is selectively received in the open space of the body member. A weighted straight bar, a generally C-shaped bar, and a tubular cushion may also be included. All components may be stored in the tubular receptacle.

15 Claims, 6 Drawing Sheets

RANGE OF MOTION EXERCISE THERAPY BAND

BACKGROUND OF THE INVENTION

This invention relates generally to physical therapy devices and, more particularly, to an apparatus and kit that provides for range of motion therapy directed to the hip and knee joints of a person.

Exercises that strengthen the muscles of the back and abdomen are the best kind of preventative medicine for back problems. Once injured, back problems can persist for months or years and result in significant financial loss, whether that loss is from medical treatment or simply being incapable of working. Often, a person with back pain, such as may be caused by inflammation from an injury, can find relief from cold therapy and gentle range of motion exercises that move a person's hips and knee joints. Cold therapy is known to reduce inflammation. Unfortunately, it may be difficult for a person with a back injury to apply cold therapy where it is needed or to coordinate range of motion exercises.

Therefore, it would be desirable to have a therapy band that enables a person to perform simple range of motion exercises while laying on the floor or bed. Further, it would be desirable to have a therapy band that enables a person to easily apply cold therapy to an affected area while performing low-impact range of motion exercises. In addition, it would be desirable to have a therapy band and accessory elements that help a person maintain core stability while performing range of motion exercises.

SUMMARY OF THE INVENTION

A range of motion therapy apparatus and kit according to the present invention includes an elongate body member having a flexible construction and generally tubular configuration defining an open space, the body member having an open proximal end and a closed distal end opposite the proximal end. The apparatus and kit includes a tubular receptacle having a closed bottom and a continuous side wall extending upwardly from the closed bottom that, together, define an interior area and an open top. The tubular receptacle includes a diameter smaller than a diameter of the body member such that the tubular receptacle is selectively received in the open space of the body member. A weighted straight bar, a generally C-shaped bar, and a tubular cushion may also be included. All components may be stored in the tubular receptacle.

Therefore, a general object of this invention is to provide a therapy apparatus and kit to enable a person to perform range of motion exercises in a stable manner.

Another object of this invention is to provide a therapy apparatus and kit, as aforesaid, having an elongate tubular band that may be configured in a loop that may be grasped by a person's hands and feet and used to coordinate range of motion exercises.

Still another object of this invention is to provide a therapy apparatus and kit, as aforesaid, having a tubular receptacle into which cold therapy may be received and then the receptacle inserted into the tubular band for application to a desired body location.

Yet another object of this invention is to provide a therapy apparatus and kit, as aforesaid, having a straight bar, a C-shaped bar, and a foam pad that may be positioned inside the therapy band to enhance its use in facilitating range of motion exercises.

A further object of this invention is to provide a therapy apparatus and kit, as aforesaid, that is portable and storable.

A still further object of this invention is to provide a therapy apparatus and kit, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
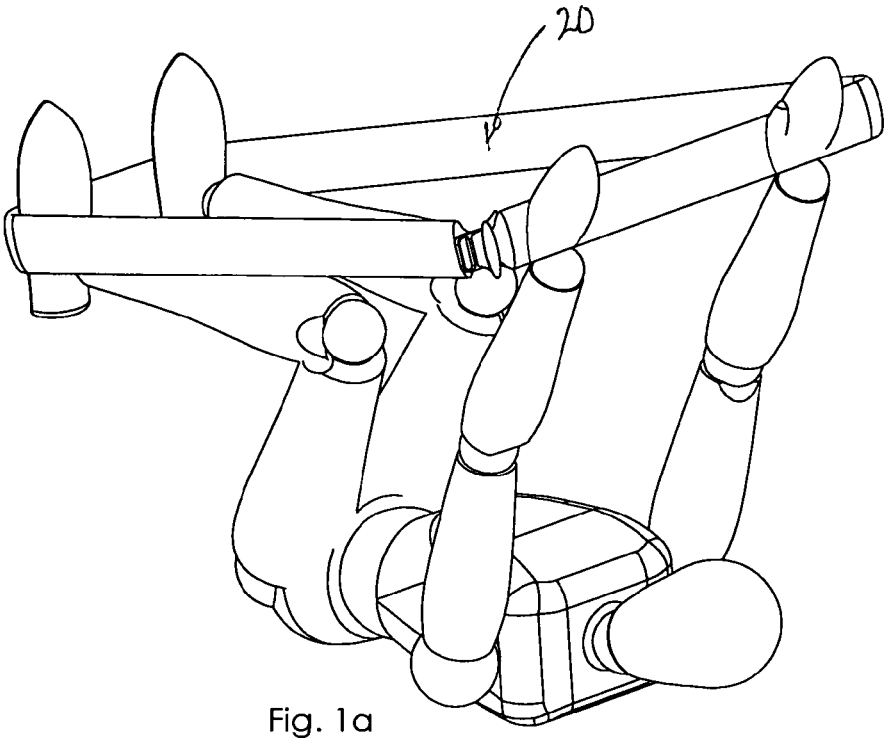
FIG. 1*a* is a perspective view of a range of motion therapy apparatus and kit according to a preferred embodiment of the present invention illustrated in use by a person.
Figure 1B:
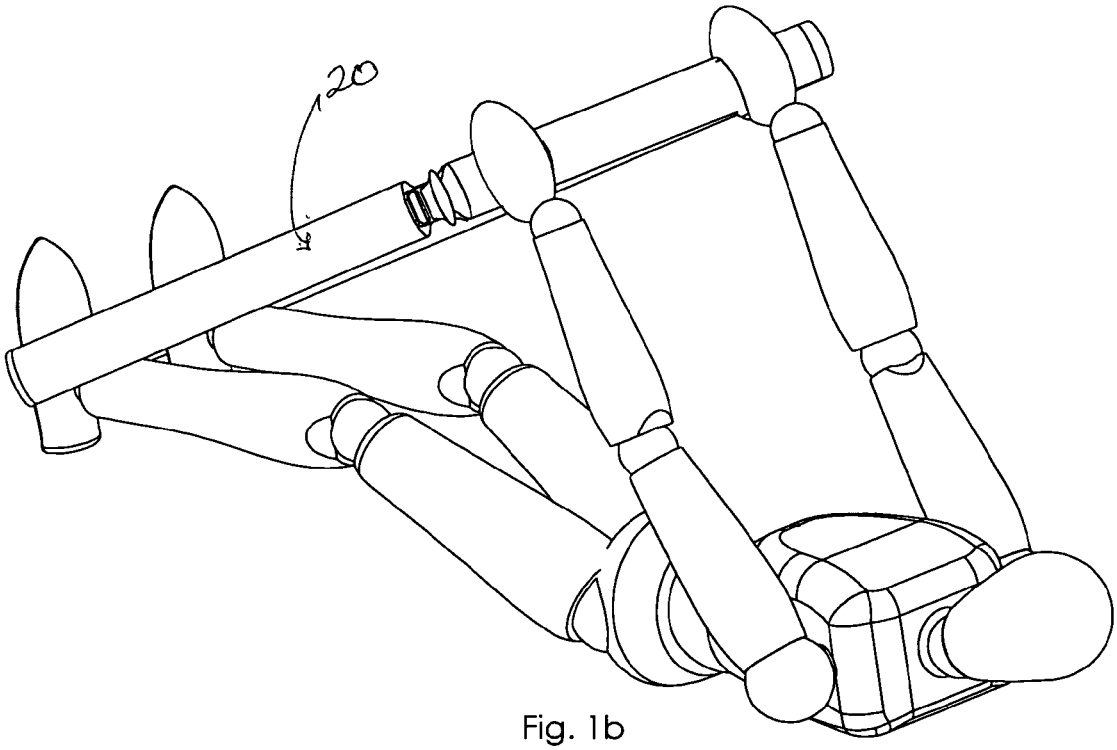
FIG. 1*b* is another perspective view of the therapy apparatus in use by a person as in FIG. 1.
Figure 2A:
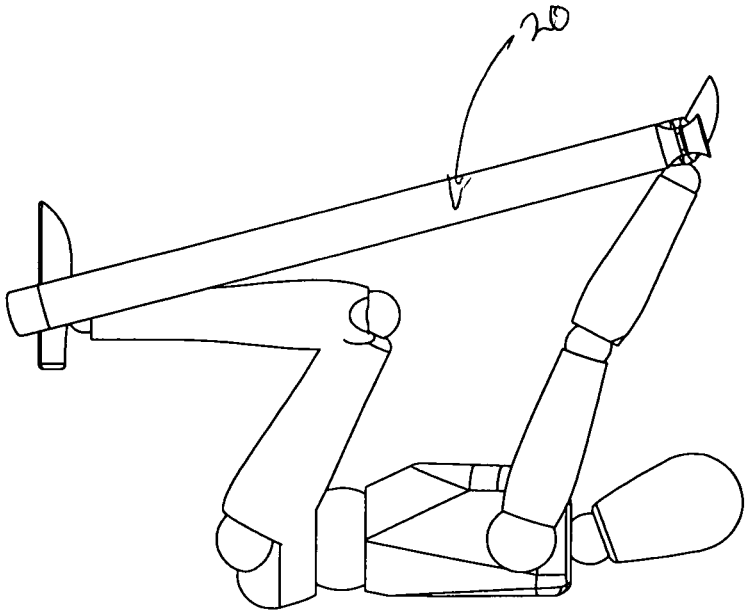
FIG. 2*a* is a side view of the therapy apparatus as in FIG. 1*a;*
Figure 2B:
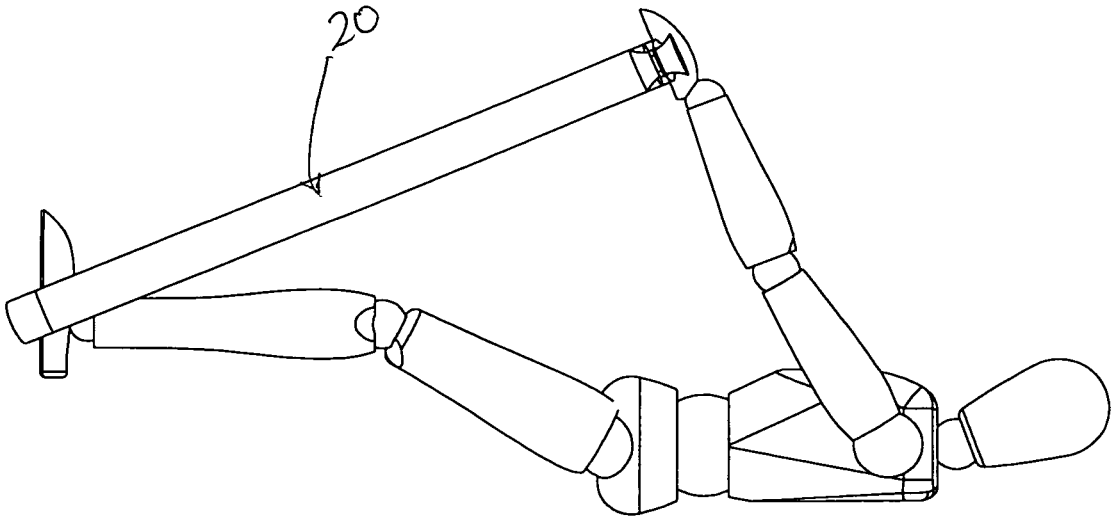
FIG. 2*b* is a side view of the therapy apparatus as in FIG. 1*b;*
Figure 3:
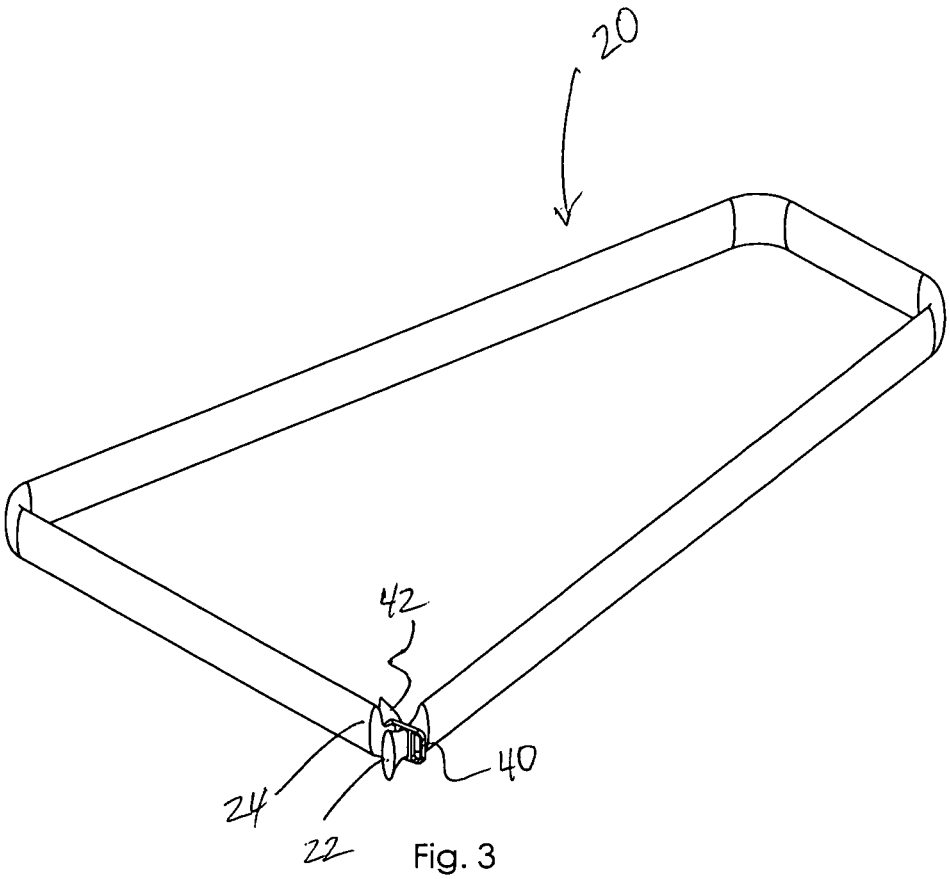
FIG. 3 is a perspective view of the body member of the therapy apparatus.

A range of motion therapy apparatus and kit according to a preferred embodiment of the present invention will now be described with reference to FIGS. 1*a* to 6*b* of the accompanying drawings.

The range of motion therapy apparatus and kit 10 includes a body member 20, also referred to as a "band." The body member 20 includes a flexible construction as it may be folded or articulated in many ways as will be described in more detail later. Preferably, the body member 20 has an elongate tubular configuration and defines a hollow open interior space. The body member 20 includes an open proximal end 22 that provides access to the interior space and an opposed distal end 24 that is closed. The body member 20 may be constructed of fabric material that has a fixed length although in other embodiments a stretchable material may also work. The open proximal end 22 includes a diameter that is equal to a diameter of the open interior space of the body member 20 such that items received into the body member 20 enter or exit through the open proximal end 22 as will be described in more detail later.

The therapy apparatus and kit 10 includes a tubular receptacle 30 having a closed bottom 32 and a continuous side wall 34 extending upwardly therefrom. The bottom 32 and side wall 34 together define an interior area and an upper edge of the side wall 34 defines an open top 36. A lid 38 may be included, such as one that may be selectively attached in a threaded arrangement. The lid 38, therefore, is movable between an attached configuration preventing access to the interior area and a released configuration allowing access to the interior area. Preferably, the tubular receptacle 30 is constructed of a waterproof material, such as plastic or metal, so as to selectively retain either solids or liquids. However, in one embodiment, the tubular receptacle 30 may be constructed of a cotton fabric or other textile construction.

For instance, the tubular receptacle 30 may retain cold items such as frozen beans, a cold pack 37, cold or warm water, or the actual components of the kit as will be further described later. When filled with cold solids or liquids, the lid 38 may be secured over the open top 36 and the receptacle 30 inserted into the body member 20 through the open proximal end 22 and used to provide comfort to a person's back or other body position having inflammation. In another embodiment, the body member 20 may be constructed such that a cold pack 37, cold beans, or other cold or heat source may be received directly into the interior area of the body member 20 and then positioned for therapy upon a person's body.

Figure 6A:
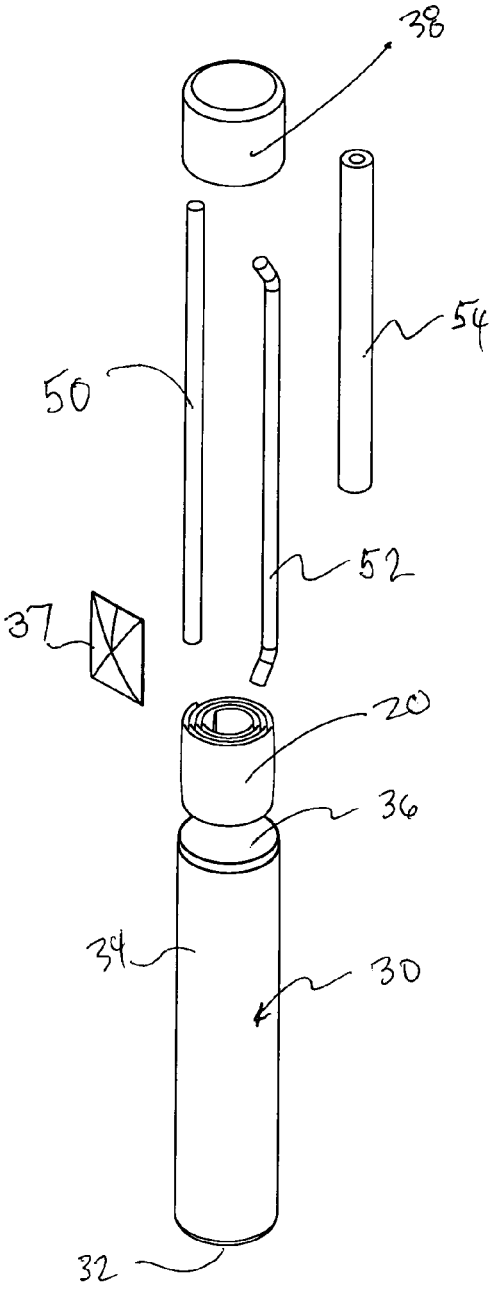
FIG. 6*a* is an exploded view of the tubular receptacle storing all components of the invention.
Figure 6B:
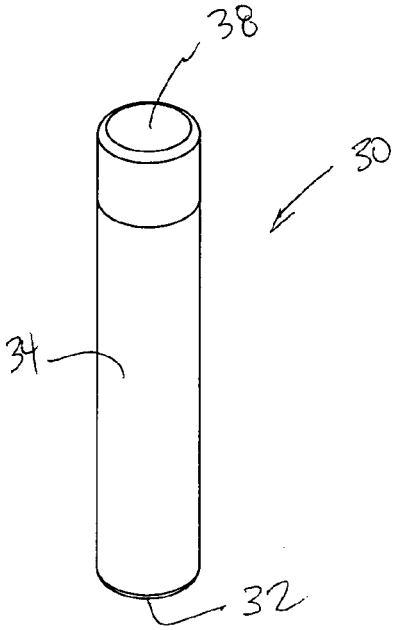
FIG. 6*b* is a perspective view of the tubular receptacle retaining all of the components shown in FIG. 6*a.*

A first fastener 40 may be coupled to the open proximal end 22 of the body member 20 and configured to selectively open or close the proximal end 22. Further, a second fastener 42 may be coupled to the closed distal end 24 even though the distal end 24 is constructed in a closed configuration. In use, the first fastener 40 may be releasably coupled to the second fastener 44 so as to selectively hold the body member 20 in a continuous loop for use in a variety of range of motion exercises or to release the body member 20 to move into an elongate linear configuration that may be rolled up into a storage configuration and stored within the interior are of the tubular receptacle 30 (FIG. 6*a*). The body member 20 is illustrated in a rolled up configuration in FIG. 6*a*. Preferably, the fasteners are selected from a group of fasteners that include latches, hooks, a hook and loop fastener combination, a snap fastener combination, or the like, although other fasteners may also be suitable.

The range of motion therapy apparatus and kit 10 may also include various elements that may be selectively positioned within the body member 20 to facilitate various forms of therapy or exercise. Specifically, the therapy apparatus 10 may include a first tube 50 having free ends and a tubular configuration. The first tube 50 may have a diameter smaller than a diameter of the interior space of the body member 20 so as to be received therein. The first tube 50 may be a weighted straight bar that may be positioned within a certain segment of the interior space of the body member 20 and used as a hand-hold or foot-hold for a user as will be described later.

In addition, the therapy apparatus and kit 10 may include a second tube 52 having a generally straight section with gently curved ends. Accordingly, the second tube 52 has an overall C-shaped configuration. Again, the second tube 52 includes a diameter that is less than a diameter of the interior space of the body member 20 so as to be selectively received therein. The second tube 52 may be positioned within a selected segment of the body member 20 and used as a handle to be grasped by a user when performing range of motion exercises as will be described more fully later.

Further, the therapy apparatus and kit 10 may include a foam pad 54 having a generally tubular configuration. The foam pad 54 includes a central longitudinal bore having a diameter slightly larger than the diameter of either the first tube 50 or the second tube 52 such that either tube may be received therein. In use, the first tube 50 or the second tube 52 may be positioned within the foam pad 54 before being positioned within the body member 20 so as to provide a softer component to be grasped by a user's hands.

In use, all of the components of the invention may be stored together. For instance, the body member 20 may be rolled up and received into the tubular receptacle 30 (FIG. 6). Similarly, the first tube 50 (straight bar), second tube 52 (C-shaped bar), and foam pad 54 may be stored in the tubular receptacle 30 until needed.

Then, some or all of the components may be used singly or in combination. For instance, if a user is suffering from back pain caused by inflammation, the receptacle 30 may be filled with frozen beans, ice water, or a cold pack, and then the receptacle inserted into the band 20. In one embodiment, a cold pack or the like may be received directly into the body member 20. The length and circuitous nature of the band 20 enables the user to properly position the receptacle 30 at just the right position for the cold and pressure to have the desired effect.

Figure 4A:
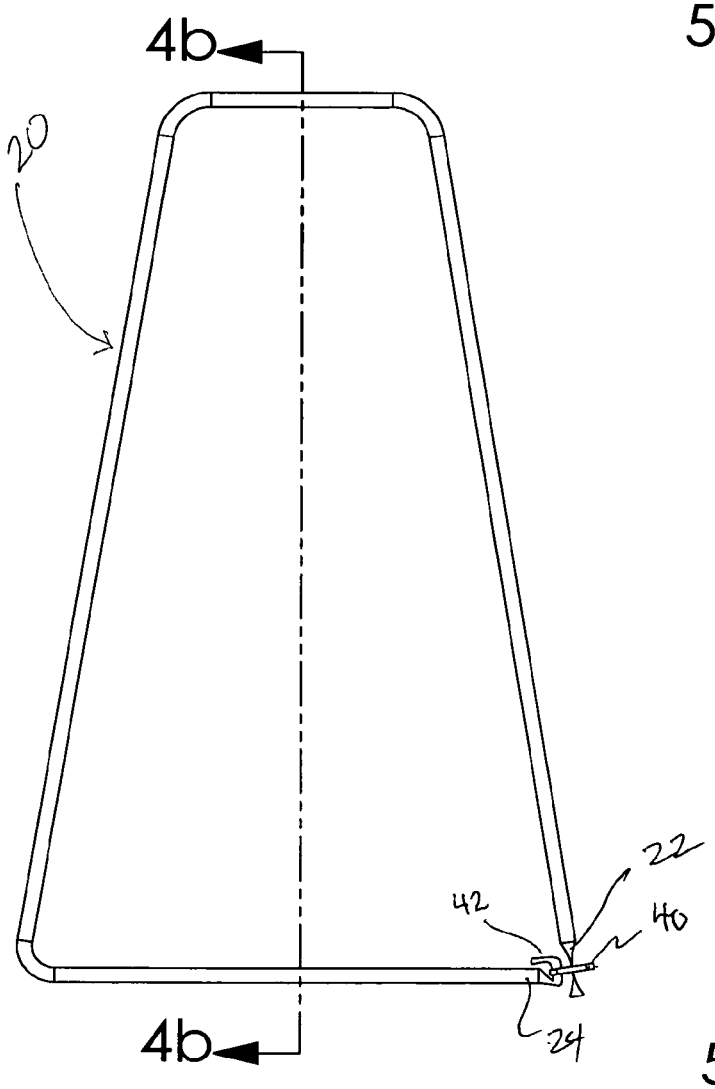
FIG. 4*a* is a side view of the body member as in FIG. 3.
Figure 4B:
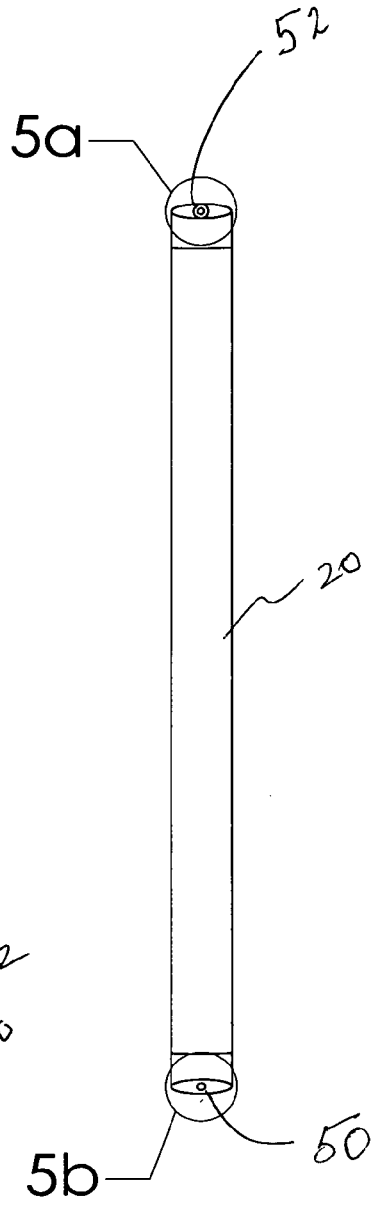
FIG. 4*b* is a section view taken along line 4*b*-4*b* of FIG. 4*a;*
Figure 5A:
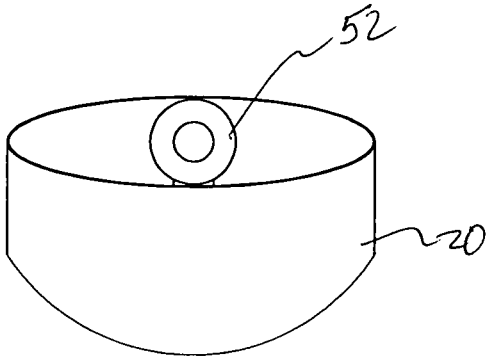
FIG. 5*a* is an isolated view on an enlarged scale taken from FIG. 4*b;*
Figure 5B:
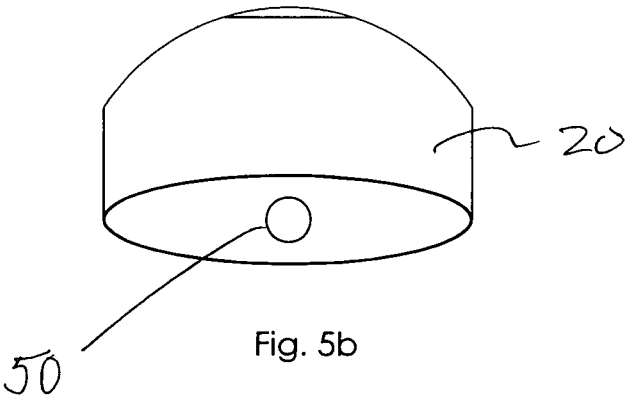
FIG. 5*b* is an isolated view on an enlarged scale taken from FIG. 4*b;*

In another example, the first tube 50 (straight bar) and second tube 52 (C-shaped bar) may be inserted into the body member 20 and positioned opposite one another (FIGS. 4*a* and 4*b*). A user may grasp the second tube 52 while placing his feet on the first tube 50 while laying on his back on the floor as shown in FIGS. 1*a* to 2*b*. This enables the user to keep his hands and feet aligned while doing range-of-motion exercises, such as to give rotational or pivotal movement to one's hip and knee joints. When finished, all of the components, including the body member 20 itself, may be returned to the interior area of the tubular receptacle 30 for storage or transport.

It is understood that while certain forms of this invention have been illustrated and described, it is not limited thereto except insofar as such limitations are included in the following claims and allowable functional equivalents thereof.

What is claimed is:

1. A range of motion therapy apparatus and kit, comprising:

an elongate body member having a flexible construction and generally tubular configuration defining an open space, said body member having an open proximal end and a closed distal end opposite said proximal end;

a tubular receptacle having a closed bottom and a continuous side wall extending upwardly from said closed bottom that, together, define an interior area and an open top;

wherein said tubular receptacle includes a diameter smaller than a diameter of said body member such that said tubular receptacle is selectively received in said open space of said body member; and wherein said body member may be rolled up and received into said tubular receptacle.

2. The therapy apparatus as in claim 1, wherein:

said body member is constructed of a fabric material; and said open proximal end includes a diameter that is equal to a diameter of said open space.

3. The therapy apparatus as in claim 1, comprising a lid selectively coupled to said open top and movable between a released configuration providing access to said interior area and an engaged configuration preventing access to said interior area.

4. The therapy apparatus as in claim 1, wherein said tubular receptacle is constructed of a waterproof material so that said tubular receptacle is selectively filled with solid or liquid contents.

5. The therapy apparatus as in claim 4, wherein said tubular receptacle is constructed of one of plastic or metal.

6. The therapy apparatus as in claim 1, comprising:

a first fastener coupled to said open proximal end of said body member and configured to selectively allow access to said open space or to prevent access to said open space; and a second fastener coupled to said closed distal end of said body member, said second fastener being releasably coupled to said first fastener.

7. The therapy apparatus as in claim 6, wherein said first fastener and said second fastener are taken from a group including latches, hooks, a hook and loop combination, and a snap fastener combination.

8. The therapy apparatus as in claim 1, comprising a first tube having a generally linear configuration, said first tube having a diameter smaller than a diameter of said open space of said body member so as to be selectively received therein.

9. The therapy apparatus as in claim 8, wherein said first tube is a weighted straight bar.

10. The therapy apparatus as in claim 1, comprising a second tube having a generally C-shaped configuration, said second tube having a diameter smaller than a diameter of said open space of said body member so as to be selectively received therein.

11. The therapy apparatus as in claim 10, comprising a foam pad having a tubular configuration and defining a diameter that is larger than said diameter of said second tube so as to selectively receive said second tube therein.

12. The therapy apparatus as in claim 8, comprising a foam pad having a tubular configuration and defining a diameter that is larger than said diameter of said first tube so as to selectively receive said first tube therein.

13. The therapy apparatus as in claim 1, comprising:

a lid selectively coupled to said open top and movable between a released configuration providing access to said interior area and an engaged configuration preventing access to said interior area;

a first fastener coupled to said open proximal end of said body member and configured to selectively allow access to said open space or to prevent access to said open space; and a second fastener coupled to said closed distal end of said body member, said second fastener being releasably coupled to said first fastener.

14. The therapy apparatus as in claim 13, comprising:

a first tube having a generally linear configuration, said first tube having a diameter smaller than a diameter of said open space of said body member so as to be selectively received therein;

a second tube having a generally C-shaped configuration, said second tube having a diameter smaller than a diameter of said open space of said body member so as to be selectively received therein; and a foam pad having a tubular configuration and defining a diameter that is larger than said diameter of said first tube and of said second tube so as to selectively receive one of said first tube or said second tube therein.

15. The therapy apparatus as in claim 14, wherein:

said tubular receptacle is constructed of a waterproof material so that said tubular receptacle is selectively filled with solid or liquid contents; and said first tube is a weighted straight bar.

* * * * *